US008127703B2

(12) United States Patent
Urakami

(10) Patent No.: US 8,127,703 B2
(45) Date of Patent: Mar. 6, 2012

(54) DEVICE CLOSELY CONTACTING OBJECT SURFACE AND MOVABLE

(76) Inventor: Fukashi Urakami, Kanagawa (JP)

( * ) Notice: Subject to any disclaimer, the term of this patent is extended or adjusted under 35 U.S.C. 154(b) by 0 days.

(21) Appl. No.: 12/312,515

(22) PCT Filed: Nov. 14, 2007

(86) PCT No.: PCT/JP2007/001239

§ 371 (c)(1),
(2), (4) Date: Mar. 31, 2010

(87) PCT Pub. No.: WO2008/065742

PCT Pub. Date: Jun. 5, 2008

(65) Prior Publication Data

US 2011/0023768 A1 Feb. 3, 2011

(30) Foreign Application Priority Data

Nov. 16, 2006 (JP) ..... 2006-310322

(51) Int. Cl.
*B63B 59/00* (2006.01)

(52) U.S. Cl. ..... 114/222

(58) Field of Classification Search ..... 114/222
See application file for complete search history.

(56) References Cited

U.S. PATENT DOCUMENTS 4,095,378 A * 6/1978 Urakami ..... 451/88
5,970,574 A * 10/1999 Thrash, Jr. ..... 15/321

FOREIGN PATENT DOCUMENTS

JP 60-26752 2/1994
JP 2003-285732 10/2003
JP 2004-151012 5/2004

* cited by examiner

*Primary Examiner* — Stephen Avila
(74) *Attorney, Agent, or Firm* — Kubotera & Associates, LLC

(57) ABSTRACT

A device capable of adhering to and moving along the surface of an object, comprising:

the main casing comprising an outer casing and an inner casing;

an outer sealing member mounted at the opening of the outer casing, part of which is caused to contact the surface of the object;

an inner sealing member mounted at the opening of the inner casing, part of which is caused to contact the surface of the object; and a means for moving along the surface of the object while maintaining the distance between the main casing and the surface of the object at a certain distance;

wherein the outer casing, the outer sealing member and the inner sealing member, together with the surface of the object, define Area I, and the inner casing and the inner sealing member, together with the surface of the object, define Area II;

wherein the pressure of fluid in Area I is maintained at a lower level than the pressure of fluid surrounding the Device, and the pressure of fluid in Area II is maintained at a higher level than the pressure of fluid in Area I.

6 Claims, 7 Drawing Sheets

DEVICE CLOSELY CONTACTING OBJECT SURFACE AND MOVABLE

TECHNICAL FIELD

This invention relates to a device capable of adhering to and moving along the surface of an object immersed in liquid.

This invention relates to a device capable of adhering to and moving along the surface of an object immersed in liquid, having an area/areas filled with gas in which the surface of the object is in contact with gas only, and having a device/s that acts on that portion of the surface of the object located within said area/s.

This invention relates to a device capable of adhering to and moving along the surface of an object immersed in liquid, having an area/areas filled with an inert gas.

This invention relates to a device capable of adhering to and moving along the surface of an object which is surrounded with gas, having an area/areas filled with an inert gas.

This invention relates to a device capable of adhering to and moving along the surface of an object which is surrounded with gas, having an area/areas filled with gas in which the surface of the object is in contact with gas only, and having a device/s that acts on that portion of the surface of the object located within said area/s.

This invention relates to a device capable of adhering to and moving along the surface of an object which is surrounded with gas, having an area/areas filled with an inert gas in which the surface of the object is in contact with the inert gas only, and having a device/s that acts on that portion of the surface of the object located within said area/s.

Such a device that is attached to the Device of the present invention and acts on the surface of an object may be an electric arc thermal spraying device, for example, but is not limited thereto. An electric arc thermal spraying device is one of many thermal spraying devices. Generally, a thermal spraying device is a device that melts a metal, such as wire, or particles and sprays the molten minute particles onto the surface of an object for coating purposes. A thermal spraying device may use 1 or 2 wires or powder as a feeding material. Heating is done by electric arc or by flames.

In addition to thermal spraying devices, the Device that is mounted onto the Device of the present invention and acts on the surface of an object may include devices that allow molten materials to adhere to a surface, such as welding devices, devices that allow plastic sheets to adhere to a surface, devices that spray paint or glue onto a surface, devices that heat-process the surface of an object, and various other devices. These devices exhibit better performance when the surface is in contact with gas than when it is in contact with liquid.

These devices exhibit further excellent performance when the surface is in contact with an inert gas.

BACKGROUND ART

Examples of those devices that adhere to the surface of an object, when negative pressure is formed internally, and move along the surface include the one described below:

A device capable of adhering to and moving along various inclined or substantially vertical surfaces of ships, buildings, etc. was disclosed in Japan Patent Application Examined Publication No. 60-26752 (U.S. Pat. No. 4,095,378 Claims and Drawings).

The Device comprises the main casing, a plurality of wheels secured to the main casing as a means for mobility, a sealing member connected to the main casing having a free end which is caused to contact the surface of an object, and a negative pressure forming means to discharge externally the liquid contained in an area defined by the main casing, the surface and the sealing member, the pressure of which is to be reduced. In such a device, the energization of the negative pressure forming means causes the liquid inside the said area to be discharged externally, and the pressure of the liquid that acts on the main casing because of the liquid pressure difference between the inside and the outside of the said area is transmitted to the surface of an object via the wheels, such liquid pressure allowing the Device to adhere to the surface. Additionally, the rotation of the wheels by way of a driving means, such as an electric motor, during such adhesion state allows the Device to move along the surface by the action of the wheels. Further, such a device has a remote-controlled working device, such as a means for blasting a cleaning and polishing material against the surface inside the said area, mounted thereon, allowing various operations on the surface of an object in a safe and efficient manner.

Examples of those devices that adhere to the surface of an object immersed in liquid, move along the surface and act on the surface include the one which is described below and is disclosed in Japan Patent Application Unexamined Publication No. 2003-285782:

Such a device is equipped with two areas filled with gas that enable the surface of the object to be in contact with gas only, and is equipped with a device that acts on the surface of the object.

This invention comprises a device capable of adhering to and moving along the surface of an object immersed in liquid, comprising the main casing at least comprising an outer casing and an inner casing, an outer sealing member mounted at the opening of the outer casing, part of which is caused to contact the surface of the object, an inner sealing member mounted at the opening of the inner casing, part of which is caused to contact the surface of the object, and a means for moving along the surface of the object while maintaining the distance between the main casing and the surface of the object at a certain distance, wherein at least the outer casing, the outer sealing member and the inner sealing member, together with the surface of the object, define Area I, and at least the inner casing and the inner sealing member, together with the surface of the object, define Area II.

Examples of those devices that adhere to the surface of an object surrounded with gas move along the surface and act on the surface include the one which is described below and is disclosed in Japan Patent Application Unexamined Publication No. 2004-151012:

This invention provides a device capable of covering the surface of an object situated in gas with a region filled with liquid and of moving such region, capable of sucking and collecting such liquid from the surface of the object wetted by the liquid and of drying such surface, and is capable of allowing such region to adhere to and crawl along the surface of the subject, while conducting ultrasonic flaw detection or ultrasonic cleaning of the surface of the object.

This invention provides a device comprising a stereoshaped first region having an annular surface A and a stereoshaped second region having an annular surface B wherein the surface A is the boundary surface between the surface of an object and Area I and the surface B is the boundary surface between the surface of an object and Area II, the portion defining the outer boundary of the surface A is provided with an outer seal member, the portion defining the inner boundary of the surface A is provided with an inner seal member, Area I is connected to a gas suction means, Area II is connected to a liquid supply means, Area I is located on the downstream side of gas surrounding the Device, Area I is located on the downstream side of Area II, and the liquid flowing out of Area II reaches Area I and is subsequently transported by suction to the suction means.

[Patent Reference 1]

Japan Patent Application Examined Publication No. 60-26752

[Patent Reference 2]

Japan Patent Application Unexamined Publication No. 2003-285782

[Patent Reference 3]

Japan Patent Application Unexamined Publication No. 2004-151012

In order to use the Device concerned to Japan Patent Application Examined Publication No. 60-26752 below the surface of a liquid, there are following problems to be solved.

The first problem is that, when a cleaning and polishing material is blasted onto the surface of an object immersed in liquid using compressed air, for example, to roughen the surface, upon which time, the used cleaning and polishing material is to be recovered and collected in a container located on land using air suction, the surrounding liquid must be disallowed to enter the blasting area of the cleaning and polishing material. There are various other operations that must also disallow the entry of liquid into the area of the surface of an object being worked on, similar to the case of the blasting operation of a cleaning and polishing material. For example, those operations that utilize a thermal spraying device, a welding device which adheres molten materials to surfaces, a device which adheres plastic sheets to surfaces, a device which sprays paint or glue onto surfaces, and a device which heat-processes surfaces are affected adversely by the entry of liquid into the area of the surface of an object being worked on. These devices exhibit better performance when the surface of the object being worked on is in contact with gas than when it is in contact with liquid.

A device that works on the surface of an object immersed in liquid whose performance is adversely affected by the entry of the liquid into the area of the surface of the object being worked on, as described above, needs to have an area free from the entry of liquid and filled with gas.

The second problem is that, when the Device immersed in liquid has an area filled with gas, the pressure of the area filled with gas needs to be controlled so that the difference between the pressure of the area filled with gas and the pressure of the liquid is kept constant as the liquid pressure may increase because it increases as the depth increases. If the liquid pressure is much greater than the pressure of the area filled with gas, the pressure of the liquid presses the area filled with gas against the surface of the object with great force, and the Device will need extremely strong power to move along the surface.

The third problem is that, when compressed gas is jetted into the area filled with said gas, as in the case of the blasting operation of a cleaning and polishing material, the compressed air pressure needs to be controlled so that the difference between the pressure of the area filled with said gas and the pressure of the compressed gas is kept constant. If the difference between the pressure of the area filled with said gas and the pressure of the compressed gas decreases, the flow of the compressed gas will decrease, and the work being performed on the surface of an object using the compressed gas will suffer imperfection.

There exists the problem to be solved as described below when the Device disclosed in Japan Patent Application Unexamined Publication No. 2003-285782 is used below the surface of the water:

That is to say, being the pressure of gas inside of Area I at a higher level than the pressure of liquid surrounds the Device, some gas inside of Area I is issued to outside of the Device through the gap between the outer sealing membrane and the surface of an object. Therefore, it is caused the pollution of the water by the Device when gas from Area I includes poisonous material such as degraded paint particle which includes heavy metal such as lead.

There exists the problem to be solved as described below when the Device disclosed in Japan Patent Application Unexamined Publication No. 2004-151012 is applied in gas:

That is to say, being filled the Area II with liquid, it is impossible for a thermal spraying device which acts on the surface of an object to be equipped with Area II. Further, being filled the Area II with liquid, it is impossible for Area II to be equipped with the Devices that allow molten materials to adhere to a surface such as welding devices, devices that allow plastic sheets to adhere to a surface, devices that spray paint or glue onto a surface, devices that heat-process the surface of an object, and various other devices.

If Area II is filled with an inert gas, it is exhibited the excellent performance for the Devices described above which are equipped with Area II because the surface inside of Area II is in contact with an inert gas.

However, it is impossible for the Devices described above to be equipped with Area II of the Device disclosed in Japan Patent Application Unexamined Publication No. 2004-151012 because Area II of the Device of the patent is filled with liquid.

Accordingly, technical objectives of the present invention are as follows:

Regarding to the first problem of the Device concerned to Japan Patent Application Examined Publication No. 60-26752, the first technical objective of the present invention is to provide a device capable of adhering to the surface of an object immersed in liquid and moving along the surface that has an area filled with gas.

Regarding to the second and the third problems of the Device concerned to Japan Patent Application Examined Publication No. 60-26752, the second and the third technical objectives and the means to solve the objectives of the present invention have been disclosed in Japan Patent Application Unexamined Publication No. 2003-285782. So description is omitted.

Regarding to the problem of the Device concerned to Japan Patent Application Unexamined Publication No. 2003-285782, the technical objective of the present invention is to provide a device capable of adhering to and moving along the surface of an object immersed in liquid, wherein the pressure of gas in Area I is so maintained at a lower level than the pressure of the liquid surrounding the Device that gas inside of Area I may not be issued outside of the Device from the gap between the outer sealing member and the surface of the object.

Regarding to the problem of the Device concerned to Japan Patent Application Unexamined Publication No. 2004-151012, the technical objective of the present invention is to provide a device capable of adhering to and moving along the surface of an object in the air, wherein the Device is so equipped with the area II which is filled with gas that the various kinds of tools which works on the surface of the object may be installed in the area II such as a thermal spraying device, a welding device which adheres molten materials to surfaces, a device which adheres plastic sheets to surfaces, a device which sprays paint or glue onto surfaces, and a device which heat-processes surfaces.

Described above were problems associated with prior art and technical objectives intended to be solved by the present invention of a device capable of adhering to and moving along the surface of an object.

DISCLOSURE OF THE INVENTION

In order to solve the technical problems described above—one of the problems is concerned with Japan Patent Application Examined Publication No. 60-26752, and another problem is concerned with Japan Patent Application Unexamined Publication No. 2003-285782, provided according to the first invention the Device capable of adhering to and moving along the surface of an object immersed in liquid, comprising the main casing at least comprising an outer casing and an inner casing; an outer sealing member mounted at the opening of the outer casing, part of which is caused to contact the surface of the object; an inner sealing member mounted at the opening of the inner casing, part of which is caused to contact the surface of the object; and a means for moving along the surface of the object while maintaining the distance between the main casing and the surface of the object at a certain distance, as described in Claim 1, wherein at least the outer casing, the outer sealing member and the inner sealing member, together with the surface of the object, define Area I, and at least the inner casing and the inner sealing member, together with the surface of the object, define Area II, wherein also the pressure of fluid in Area I is maintained at a lower level than the pressure of fluid surrounding the Device, and the pressure of fluid in Area II is maintained at a higher level than the pressure of fluid in Area I.

Also provided is a device capable of adhering to and moving along the surface of an object described in Claim 1, wherein the outer sealing member is so shaped as to be caused to be pressed against the surface of the object by the difference in pressure between the pressure of fluid in Area I and the pressure of fluid surrounding the Device, and the inner sealing member is so shaped as to be caused to be pressed against the surface of the object by the difference in pressure between the pressure of fluid in Area I and the pressure of fluid in Area II, as described in Claim 3.

Also provided is a device capable of adhering to and moving along the surface of an object described in Claims 1 and Claim 3, wherein a means is provided for an inert gas to flow into Area II, as described in Claim 4.

In order to solve the technical problems described above which is concerned with the Device disclosed in Japan Patent Application Unexamined Publication No. 2004-151012, provided according to the second invention the Device capable of adhering to and moving along the surface of an object in the air, comprising the main casing at least comprising an outer casing and an inner casing; an outer sealing member mounted at the opening of the outer casing, part of which is caused to contact the surface of the object; an inner sealing member mounted at the opening of the inner casing, part of which is caused to contact the surface of the object; and a means for moving along the surface of the object while maintaining the distance between the main casing and the surface of the object at a certain distance, as described in Claim 2, wherein at least the outer casing, the outer sealing member and the inner sealing member, together with the surface of the object, define Area I, and at least the inner casing and the inner sealing member, together with the surface of the object, define Area II, wherein also the pressure of fluid in Area I is maintained at a lower level than the pressure of fluid surrounding the Device, and the pressure of gas in Area II is maintained at a higher level than the pressure of fluid in Area I.

Also provided is a device capable of adhering to and moving along the surface of an object described in Claim 2, wherein the outer sealing member is so shaped as to be caused to be pressed against the surface of the object by the difference in pressure between the pressure of fluid in Area I and the pressure of fluid surrounding the Device, and the inner sealing member is so shaped as to be caused to be pressed against the surface of the object by the difference in pressure between the pressure of fluid in Area I and the pressure of fluid in Area II, as described in Claim 3.

Also provided is a device capable of adhering to and moving along the surface of an object described in Claims 2 and Claim 3, wherein a means is provided for an inert gas to flow into Area II, as described in Claim 4.

The Device of the first invention is so made that the pressure of gas in Area I is maintained at a lower level than the pressure of the liquid that surrounds the Device, in addition the Device of the first invention is so made that the pressure of gas in Area II is maintained at a higher level than the pressure of gas in Area I, still more the Device of the first invention is so made that the pressure of gas in Area II is maintained at a lower level than the pressure of the liquid that surrounds the Device, thereby the Device is enabled to adhere to the surface of an object by the action of negative pressure, thereby also the liquid is prevented from entering Area II.

Being delivered gas into Area II from the outside of the device via the pressure control device of gas and through the flexible air hose, further being connected the Area I onto the negative pressure forming means such as the Roots vacuum pump through the flexible suction hose, the liquid outside of the Device flows into Area I through the gap between the outer sealing member and the surface of the object, subsequently the liquid is delivered to the negative pressure forming means by the suction gas flow which is delivered to the negative pressure forming means through the flexible suction hose after gas being flowed into Area I from Area II through the gap between the inner sealing member and the surface of the object.

Further, the means for maintaining the distance between the main casing and the surface of an object at a certain distance and moving along the surface of the object enables the Device to move along the surface of the object while adhering to the surface of the object immersed in liquid.

Further, the Device is so made as to controls the pressure of the areas filled with gas so that the difference between the pressure of the areas filled with gas and the pressure of the liquid surrounding the Device is kept constant when the pressure of the liquid increases as the depth increases.

The Device of the second invention is so made that the pressure of gas in Area I is maintained at a lower level than the pressure of gas that surrounds the Device, in addition the Device of the second invention is so made that the pressure of gas in Area II is maintained at a higher level than the pressure of gas in Area I, still more the Device of the second invention is so made that the pressure of gas in Area II is maintained at a lower level than the pressure of gas that surrounds the Device, thereby the Device is enabled to adhere to the surface of an object by the action of negative pressure, thereby also gas is prevented from entering Area II.

Being delivered gas into Area II from the outside of the Device via the pressure control device of gas and through the flexible air hose, further being connected the Area I onto the negative pressure forming means such as the Roots vacuum pump through the flexible suction hose, gas outside of the Device flows into Area I through the gap between the outer sealing member and the surface of the object, subsequently gas is delivered to the negative pressure forming means by the suction gas flow which is delivered to the negative pressure forming means through the flexible suction hose after gas being flowed into Area I from Area II through the gap between the inner sealing member and the surface of the object.

Further, the means for maintaining the distance between the main casing and the surface of an object at a certain distance and moving along the surface of the object enables the Device to move along the surface of the object while adhering to the surface of the object immersed in liquid.

Effects of the Present Invention Will Be Explained Below.

In reference to the effects of the first invention, when a cleaning and polishing material is blasted onto the surface of an object immersed in liquid using compressed air, for example, to roughen the surface, upon which time, the used cleaning and polishing material is to be recovered and collected in a container located on land using air suction, the surrounding liquid must be disallowed to enter the blasting area of the cleaning and polishing material. There are various other operations that must also disallow the entry of liquid into the area of the surface of an object being worked on, similar to the case of the blasting operation of a cleaning and polishing material. For example, an operation that uses a thermal spraying device, a device that adheres molten materials to surfaces, such as a welding device, a device that adheres plastic sheets to surfaces, a device that sprays paint or glue onto surfaces, and a device that heat-processes surfaces is affected adversely by the entry of liquid into the area of the surface of an object being worked on.

A device that works on the surface of an object whose performance is adversely affected by the entry of liquid into the area of the surface of the object being worked on, as described above, needs to have an area free from the entry of liquid and filled with gas.

The Device of the present invention has a mechanism that prevents liquid from entering the area of the surface of an object that is being worked on.

These devices will exhibit better performance when the surface of the object being worked on is in contact with gas than when it is in contact with liquid.

Some of these devices exhibit further excellent performance when the surface is in contact with an inert gas in which the concentration of oxygen is at low level.

For example, a thermal spraying device or a welding device has an advantage in that the quality is increased because the oxidation of the melted material is inhibited in order that the material is melted in an inert gas.

In reference to the additional effects of the first invention, when the Device immersed in liquid has an area filled with gas, the pressure of the area filled with gas needs to be controlled so that the difference between the pressure of the area filled with gas and the pressure of the liquid is kept constant as the liquid pressure may increase because it increases as the depth increases. If the liquid pressure is much greater than the pressure of the area filled with gas, the pressure of the liquid presses the area filled with gas against the surface of the object with great force, and the Device will need extremely strong power to move along the surface.

The Device of the present invention is so made as to control the pressure of the area filled with gas so that the difference between the pressure of the area and the pressure of the liquid is kept constant when the pressure of the liquid may increase as the depth increases.

In reference to the common effects to the first invention and the second invention, when compressed gas is jetted into the area filled with gas, as in the case of the operation of blasting a cleaning and polishing material, the compressed air pressure needs to be controlled so that the difference between the pressure of the area filled with gas and the pressure of the compressed gas is kept constant. If the difference between the pressure of the area filled with gas and the pressure of the compressed gas decreases, the flow of the compressed gas will decrease, and the work being performed on the surface of an object using the compressed gas will suffer imperfection.

The Device of the present invention is so made as to control the pressure of compressed gas so that the difference between the pressure of the area filled with gas and the pressure of compressed gas is kept constant.

DESCRIPTIONS OF THE PREFERRED EMBODIMENTS

Preferred embodiments of the Device configured according to the present invention will be described in detail below, referring to the figures attached hereto.

In reference to FIG. 1, FIG. 2, FIG. 4 and FIG. 5, the Device illustrated in FIG. 1 and FIG. 2 is closely adhered to the surface of an object 1 immersed in shallow water or immersed in the atmosphere, and moves in the right or left direction as shown in FIG. 1.

The Device illustrated therein has a main casing. The main casing is made of a rigid material and is comprised of a cylindrical partition on the outer periphery 21, and a cylindrical partition on the inner periphery 22 and a disc-shaped partition on the back side 23.

The cylindrical partition on the inner periphery 22 comprises a cylinder that is open where it faces the surface of an object 1 and an annular disc welded to the outer periphery of the opening of the cylinder.

The cylindrical partition on the outer periphery 21 comprises a cylinder that is open where it faces the surface of an object 1 and an annular disc welded to the outer periphery of the opening of the cylinder.

Fixed onto the two sides of the cylindrical partition on the outer periphery is a pair of travelling frames 4 made of a rigid material each having two wheels 41.

Installed with bolts and nuts on the annular disc of the cylindrical partition on the outer periphery 21 is an outer seal member 31 made of a relatively flexible material, such as polyurethane rubber or plastic. The outer seal member 31 has an approximate ring shape with its free end extending along the surface of an object 1 and to the outside of the Device. Because of this shape, the outer seal member 31 is pressed against the surface of an object 1 by the pressure of fluid outside the outer seal member 31. In other words, the outer seal member 31 has a so-called self-sealing shape.

Installed with bolts and nuts on the annular disc of the cylindrical partition on the inner periphery 22 is an inner seal member 32 made of a relatively flexible material, such as polyurethane rubber or plastic. The inner seal member 32 has an approximate ring shape with its free end extending along the surface of an object 1 and to the inside of the Device. Because of this shape, the inner seal member 32 is pressed against the surface of an object 1 by the pressure of fluid inside the inner seal member 32. In other words, the inner seal member 32 has a so-called self-sealing shape.

The cylindrical partition on the outer periphery 21, the cylindrical partition on the inner periphery 22, the outer seal member 31, the inner seal member 32 and the disc-shaped partition on the back side 23, together with the surface of an object 1, define the annular first region 11. The cylindrical partition on the inner periphery 22, the inner seal member 32 and the disc-shaped partition 23, together with the surface of an object 1, define Area II 12.

Installed at the disc-shaped partition on the back side 23 is an electric arc thermal spray gun 82 as one of the Devices that act on the surface of the object 1 in Area II 12.

The configuration of a traditional electric arc thermal spraying device is described below in reference to FIG. 3.

Two wires for thermal spraying made of such metal as zinc or aluminum 821 (hereinafter referred to as the "wires 821") are fed to the electric arc thermal spray gun 82 through flexible conduits 828 by a wire feeding device 83 that has a wire reel. Inside the electric arc thermal spray gun 82, the wires 821 are fed to the wire nozzles 822. current-carrying terminals either for AC or DC (not illustrated) installed within the wire nozzles 822 energize each of the wires 821. The wires 821 generate arc by cross-contacting when the wire nozzles 822 are exited. At this time, the wires 821 are instantaneously heated by the heat of the arc and melt into minute particles, which are in turn made into finer particles (or a mist-like state) by the action of compressed gas such as compressed air jetted out of a gas nozzle 823 situated midway between the two wire nozzles 822, which particles are dispersed while being cooled and collide against the surface of the object, forming molten metal film.

Generally, the arc current is several hundred amperes.

The gun casing 826 of the electric arc thermal spraying device that contacts the wires 821 and the wire nozzles 822, among other members, is made of an electrically non-conductive material, such as hard plastic.

The system of a wire feeding mechanism and the arrangement of the wire feeding device 83 are not crucial in the present invention. Any other appropriate or common feeding mechanism may be used, and the feeding mechanism may be arranged within the electric arc thermal spray gun 82, as widely known.

Neither the type or structural details of the electric arc thermal spraying device as described above are crucial in the present invention, nor should it be limited to the embodiment example of the present invention. Other shapes may also be used.

Further, the Device mounted onto the Device of the present invention that acts on the surface of the object 1 is not limited to the electric arc thermal spraying device. The electric arc thermal spraying device is only one of many thermal spraying devices. Generally, a thermal spraying device is a device that melts a metal, such as wire, or particles and sprays the molten minute particles onto the surface of an object to form coating. A thermal spraying device may use 1 or 2 wires or powder as a feeding material. Heating is done by electric arc or by flames.

Further, in addition to thermal spraying devices, other devices that act on the surface of an object which may be mounted onto the Device of the present invention include devices that allow molten materials to adhere to a surface, such as welding devices, devices that allow plastic sheets to adhere to a surface, devices that spray paint or glue onto a surface, devices that heat-process the surface of an object, and various other devices. These devices exhibit better performance when the surface is in contact with gas than when it is in contact with liquid.

Some of these devices exhibit further excellent performance when the surface is in contact with an inert gas in which the concentration of oxygen is at low level.

For example, a thermal spraying device or a welding device has an advantage in that the quality is increased because the oxidation of the melted material is inhibited in order that the material is melted in an inert gas.

A coupler 211 welded to the disc-shaped partition on the back side 23 and connected to Area I 11 is connected via hose 961 to the inlet of a cyclone 963 located downstream, and the outlet of the cyclone 963 is further connected via hose 962 to the inlet of the Roots vacuum pump 96.

The Roots vacuum pump 96 has sufficient suction capacity and sufficient suction pressure. To prevent seizure caused by excessive vacuum, the Roots vacuum pump has a vacuum breaker 863 at the input side thereof that has the function of lowering the intensity of vacuum by sucking in external air in case excessive vacuum occurs.

The Device of an embodiment example of this invention assumes the maximum suction pressure of the vacuum pump 96 to be approximately 0.35 kgf/cm2 in terms of the absolute pressure. Because pressure loss occurs when a gas is transported by suction through the hose 961, the Pa value of the absolute pressure of Area I: Pa kgf/cm2, is assumed to be approximately 0.62.

Installed at the bottom of the cyclone 963 is a rotary feeder 964 for the purpose of discharging the water collected inside the cyclone 963 to an outside water storage tank 97.

A coupler 221 welded to the disc-shaped partition on the back side 23 and connected to Area II 12 is connected via hose 952 to a coupler 923 of a downstream side valve chest 932 of a pressure control valve 92 located upstream, and a coupler 922 of an upstream side valve chest 931 of the pressure control valve 92 is further connected via hose 951 to the outlet of a gas supply pump 95 located further upstream.

The inlet of the gas supply pump 95 is opened to the atmosphere in order to take in the air, otherwise the inlet of the gas supply pump 95 is connected to an inert gas generating device 97 which makes an inert gas in which the concentration of oxygen is at low level such as the exhaust gas of the diesel.

The Device of an embodiment example of this invention assumes the maximum capacity of the gas supply pump 95 to be approximately 12 kgf/cm2 in terms of the absolute pressure. Because considerable pressure loss occurs when a gas is transported through a small-diameter hose 951, the Pc value of the absolute pressure of the upstream side valve chest: Pc kgf/cm2 is assumed to be approximately 4.

Detailed description of pressure control valve 92 is as follows. The casing 921 of the pressure control valve 92 is roughly divided into two chambers: valve storage chamber and valve drive chamber. Inside the valve storage chamber, a disc-shaped valve 927 is caused to descend and close the valve opening 931 of a cm in diameter D, and to ascend and open the valve opening 931 by a drive rod 926. While the valve 927 keeps the valve opening 931 closed, the valve storage chamber is divided into two chests: the upstream side valve chest 931 and the downstream valve chest 932. In the figures of the present embodiment example, the upstream side valve chest 931 and the valve opening 931 are one and the same.

Inside the valve drive chamber, a circular film diaphragm 929 divides the valve drive chamber into two chambers: a pilot pressure chamber 933 and an upstream side pressure chamber 934. While the valve 927 keeps the valve opening 931 closed, the diaphragm 929 keeps a disc-shaped piston 928 of b cm in diameter D pressed down. Fixed onto the disc-shaped piston 928 is the drive rod 926.

Because the coupler 922 of the upstream side valve chest 931 and the coupler 925 of the upstream side pressure chamber 934 are connected by a hose, the pressure of the upstream valve chamber 931 and the pressure of the upstream side pressure chamber 934 are the same. Further, when the diameter D a cm of the valve opening 931 and the diameter D b cm of the piston 928 are the same, the force Fc that pushes the valve 927 upwards to try to open the valve opening 931 and the force Fd that pushes the piston 928 downward to try to close the valve opening 931 are balanced.

The coupler 924 of the pilot pressure chamber 933 is connected via hose 942 to pressure reducing and relieving valve 943 located upstream and to an air compressor 94 located further upstream relative to the said coupler. The absolute pressure of the pilot pressure chamber 933: Px kgf/cm2 is set by the pressure reducing valve 943, and any positive number higher than 0 can be selected for the value of Px. If the absolute pressure of the pilot pressure chamber 933 is desired to be lower than the atmospheric pressure (absolute pressure: 1.0332 kgf/cm2), however, the value of Px must be smaller than 1.0332.

The absolute pressure of the pilot pressure chamber 933: Px kgf/cm2 generates a force Fx that pushes the piston 928 upwards to try to open the valve opening 931. The absolute pressure of the downstream side valve chest 932, i.e., of Area II 12: Pb kgf/cm2 generates a force Fb that pushes the valve 927 downward to try to close the valve opening 931. The diameter D a cm of the valve opening 931 and the diameter D b cm of the piston 928 of the Device of an embodiment example of this invention are the same, and therefore, the valve 927 opens when Pb<Px and the valve 927 closes when Pb>Px. Assuming that the standard value of the absolute pressure of Area II of the Device of an embodiment example of this invention: Pb kgf/cm2 to be approximately 0.65, the absolute pressure of the pilot pressure chamber 933: Px kgf/cm2 is set at 0.65 kgf/cm2 so as to maintain the absolute pressure of Area II at 0.65 kgf/cm2 In other words, the valve 927 opens when Pb<0.65 and the valve 927 closes when Pb>0.65.

Detailed description of pressure control valve 92*b* is as follows.

The pressure control valve 92*b* is described in reference to FIG. 4 because the pressure control valve 92*b* has the same structure as the pressure control valve 92 has. However, several parts names and several laying pipes of the pressure control valve 92*b* are different from them of the pressure control valve 92.

Detailed description of pressure control valve 92*b* is as follows. The casing 921 of the pressure control valve 92 is roughly divided into two chambers: valve storage chamber and valve drive chamber. Inside the valve storage chamber, a disc-shaped valve 927 is caused to descend and close the valve opening 931 of a cm in diameter D, and to ascend and open the valve opening 931 by a drive rod 926. While the valve 927 keeps the valve opening 931 closed, the valve storage chamber is divided into two chests: the upstream side valve chest 931 and the downstream valve chest 932. In the figures of the present embodiment example, the upstream side valve chest 931 and the valve opening 931 are one and the same.

Inside the valve drive chamber, a circular film diaphragm 929 divides the valve drive chamber into two chambers: a pilot pressure chamber 934 and an downstream side pressure chamber 933. While the valve 927 keeps the valve opening 931 closed, the diaphragm 929 keeps a disc-shaped piston 928 of b cm in diameter D pressed down. Fixed onto the disc-shaped piston 928 is the drive rod 926.

Because the coupler 923 of the downstream side valve chest 932 and the coupler 924 of the downstream side pressure chamber 933 are connected by a hose, the pressure of the downstream valve chamber 932 and the pressure of the downstream side pressure chamber 933 are the same. Further, when the diameter D a cm of the valve opening 931 and the diameter D b cm of the piston 928 are the same, the force Fc that pushes the valve 927 upwards to try to open the valve opening 931 and the force Fd that pushes the piston 928 downward to try to close the valve opening 931 are balanced.

The coupler 925 of the pilot pressure chamber 934 is connected via hose 942*b* to pressure reducing and relieving valve 943*b* located upstream and to an air compressor 94 located further upstream relative to the said coupler. The absolute pressure of the pilot pressure chamber 934: Px kgf/cm2 is set by the pressure reducing valve 943*b*, and any positive number higher than 0 can be selected for the value of Px. If the absolute pressure of the pilot pressure chamber 933 is desired to be lower than the atmospheric pressure (absolute pressure: 1.0332 kgf/cm2), however, the value of Px must be smaller than 1.0332.

The absolute pressure of the pilot pressure chamber 934: Px kgf/cm2 generates a force Fx that pushes the piston 928 upwards to try to open the valve opening 931. The absolute pressure of the downstream side valve chest 932, i.e., of Area I 11: Pa kgf/cm2 generates a force Fb that pushes the valve 927 downward to try to close the valve opening 931. The diameter D a cm of the valve opening 931 and the diameter D b cm of the piston 928 of the Device of an embodiment example of this invention are the same, and therefore, the valve 927 closes when Pa<Px and the valve 927 opens when Pa>Px. Assuming that the standard value of the absolute pressure of Area I 11 of the Device of an embodiment example of this invention: Pa kgf/cm2 to be approximately 0.62, the absolute pressure of the pilot pressure chamber 934: Px kgf/cm2 is set at 0.62 kgf/cm2 so as to maintain the absolute pressure of Area I 11 at 0.62 kgf/cm2 In other words, the valve 927 closes when Pa<0.62 and the valve 927 opens when Pa>0.62.

Actions and effects of the Device of the preferred embodiment example of this invention described above are explained below.

When the vacuum pump 96 is activated, the air inside Area I 11 is sucked toward the downstream side, and the pressure in Area I 11 is reduced as required (the absolute pressure of Area I 11: Pa=0.62 kgf/cm2). When the pressure of Area I 11 is thus reduced, the pressure of the air surrounding the Device (the absolute pressure: Po=1.0331 kgf/cm2) presses Area I 11 in the direction of the surface of an object 1 due to the pressure difference between the inside and the outside of Area I 11 (Po−Pa=0.4132 kgf/cm2), such pressing force being transmitted to the surface of an object 1 via the four wheels 41, whereby the Device adheres to the surface of an object 1 by suction, and moves along the surface of an object 1 when the wheels 41 are driven and rotated by a drive means, such as a geared motor (not illustrated), at this time. Further, when the pressure inside Area I 11 is kept at a certain desired pressure, the air surrounding the Device presses the free end of the outer seal member 31 in the direction of the surface of an object 1 due to the pressure difference between the inside and the outside of Area I 11, thereby preventing the air from entering Area I 11 as much as possible. However, it is not necessary to prevent all the air from trying to enter Area I 11 through a minute gap between the free end of the outer seal member 31 and the surface of an object 1. Rather, allowing the air to enter the region to a certain extent will enhance the function of suction and collection of the water that flowed into Area I 11 from Area II 12 toward and at the vacuum pump.

The pressure of gas inside Area II 12 presses the free end of the inner seal member 32 in the direction of the surface of an object 1, thereby preventing the gas from flowing into Area I 11 as much as possible.

Because the valve 927 of the pressure control valve 92 is set so that the valve 927 is open when Pb<0.65 where Pb is the absolute pressure of Area II 12: Pb kgf/cm2, water that is supplied when the gas supply pump 95 is activated flows into Area II 12 from the opened valve 927, and the valve 927 is closed when the absolute pressure of Area II 12 rises to 0.65 kgf/cm2. After the passage of a little time, the water inside Area II 12 flows into Area I 11 through a minute gap between the free end of the inner seal member 32 and the surface of an object 1, and the absolute pressure of Area II 12 decreases to less than 0.65 kgf/cm2, thereby opening the valve 927 again. Subsequently, the valve 927 thus opens and closes repeatedly and maintains the absolute pressure of Area II 12 at a certain value.

The water that flowed from Area II 12 into Area I 11 is transported by suction to the cyclone 963 together with the air that entered Area I 11 through a minute gap between the free end of the outer seal member 31 and the surface of an object 1. After being separated from the air at the cyclone 963, the water is returned to the water storage tank 97 by the rotary feeder 964, and the separated air is discharged back into the atmosphere through the vacuum pump 96.

Because the absolute pressures of Area I 11 and Area II 12 of the Device of an embodiment example of this invention are both lower than the absolute pressure of the atmosphere, the atmospheric pressure presses Area I 11 and Area II 12 in the direction of the surface of an object 1, whereby Area I 11 and Area II 12 adhere to the surface of an object 1 by suction. At this time, the pressing force of the atmosphere is transmitted to the surface of an object 1 via the four wheels 41, whereby the Device adheres to the surface of an object 1 and moves along the surface of an object 1 when the wheels 41 are driven and rotated by a drive means, such as a geared motor (not illustrated).

The operational principle of the pressure control valve 92 will be explained below by referring to FIG. 4 and formulas.

The aggregate force that acts downwards on the valve 927 toward its closing position Ft1 kgf is: Fb=Pb*Da*Da*3.14/4 Fd=Pc*Db*Db*3.14/4 Da=Db Ft1=Fb+Fd Ft1=(Pb+Pc)* Da*Da*3.14/4

The aggregate force that acts upwards on the valve 927 toward its opening position Ft2 kgf is: Fc=Pc*Da*Da*3.14/4 Fx=Px*Db*Db*3.14/4 Da=Db Ft2=Fc+Fx Ft2=(Pc+Px)* Da*Da*3.14/4

The conditions for the valve 927 to open are: Ft1<Ft2 (Pb+Pc)*Da*Da*3.14/4<(Pc+Px)*Da*Da*3.14/4 Pb+Pc<Pc+Px Pb<Px where Pb kgf/cm2 is the absolute pressure of Area II 12 and the downstream side valve chest 932, Pc kgf/cm2 is the absolute pressure of the upstream side valve chest 931 and the upstream side pressure chamber 934, Px kgf/cm2 is the absolute pressure of the pilot pressure chamber 933, Fb kgf is the force that presses downwards the valve 927 of the downward side valve chest 932, Fc kgf is the force that presses upwards the valve 927 of the upstream side valve chest 931, Fd kfg is the force that presses downwards the piston 928 at the upstream side pressure chamber 934, Fx kgf is the force that presses upwards the piston 928 at the pilot pressure chamber 933, Da cm is the effective diameter of the valve 927, Db cm is the effective diameter of the piston 928, and Da=Db.

The above formulas show that the pressure of Area II 12 can easily be adjusted to a goal pressure independent from the pressure of the upstream side valve chest 931 so long as the Px value of the absolute pressure of the pilot pressure chamber 933: Px kgf/cm2 and the Pb value of the absolute pressure of Area II 12: Pb kgf/cm2 that is the goal value of pressure setting are made equal.

Explained below referring to FIG. 6 is another embodiment example of the pressure control valve 92.

The only differences between the pressure control valve 92 in FIG. 6 and the pressure control valve 92 in FIG. 4 are that the coupler 924 of the pilot pressure changer 933 is open to the atmosphere and that the former has a coil spring 935 that presses the piston 928 of the upstream side pressure chamber 934 downwards.

The operational principle of the pressure control valve 92 shown in FIG. 6 will be explained below by using formulas.

The aggregate force that acts downwards on the valve 927 toward its closing position Ft1 kgf is: Fb=Pb*Da*Da*3.14/4 Fd=Pc*Db*Db*3.14/4 Da=Db Ft1=Fb+Fd+Fs Ft1=(Pb+Pc)* Da*Da*3.14/4+Fs The aggregate force that acts upwards on the valve 927 toward its opening position Ft2 kgf is: Fc=Pc*Da*Da*3.14/4 Fx=1.0332*Db*Db*3.14/4 Da=Db Ft2=Fc+Fx Ft2=(Pc+1.0332)*Da*Da*3.14/4

The conditions for the valve 927 to open are: Ft1<Ft2 (Pb+Pc)*Da*Da*3.14/4+Fs<(Pc+1.0332)*Da*Da*3.14/4 Fs<(1.0332−Pb)*Da*Da*3.14/4

Where Pb kgf/cm2 is the absolute pressure of Area II 12 and the downstream side valve chest 932, Pc kgf/cm2 is the absolute pressure of the upstream side valve chest 931 and the upstream side pressure chamber 934, The absolute pressure (the atmospheric pressure) of the pilot pressure chamber is 0.0332 kgf/cm2, Fb kgf is the force that presses downwards the valve 927 of the downstream side valve chest 932, Fc kgf is the force that presses upwards the valve 927 of the upstream side valve chest 931, Fd kfg is the force that presses downwards the piston 928 at the upstream side pressure chamber 934, Fx kgf is the force that presses upwards the piston 928 at the pilot pressure chamber 933, Da cm is the effective diameter of the valve 927, Db cm is the effective diameter of the piston 928, Da=Db and Fs kgf is the force of the coil spring 935 that presses downwards the piston 928 at the upstream pressure chamber 934.

The above formulas show that the force of the coil spring 935 that presses downwards the piston 928: Fs kgf is expresses as functions of the Pb value of the absolute pressure of Area II 12: Pb kgf/cm2 that is the goal value of pressure setting and the effective diameter of the valve 927: Da cm.

In other words, it is shown that that the pressure of Area II 12 can easily be adjusted to a goal pressure independent from the pressure of the upstream side valve chest 931.

In comparison to the pressure control valve 92 shown in FIG. 4, the pressure control valve 92 shown in FIG. 6 is advantageous in that it does not require pressure setting of the pilot pressure chamber 933. Either of the pressure control valves can be used with the Device of this invention.

The reason that it is important to adjust the pressure of Area II 12 to a certain designated pressure using the pressure control valve 92 is explained below:

It is advantageous to maintain the pressure of Area II 12 at a lower level because it reduces the quantity of water flowing out of Area II 12 into Area I 11; Area II 12 can adhere to the surface of an object 1 if the pressure of Area II 12 is lower than the atmospheric pressure. On the other hand, the pressure of the gas supply pump 95 fluctuates depending upon the length of the hose 951, and pressure loss of the hose 951 is rather great. A water supply pump with a greater pressure capacity must be selected, for that reason, for the gas supply pump 95.

If the pressure capacity of the gas supply pump 95 is great, the diameter of the hose 951 can be made smaller. This in turn requires a pressure control valve having a pressure reduction function at the downstream side of the gas supply pump 95.

The pressure control valve 92 of the Device of an embodiment example of this invention has a superior characteristic of lowering the pressure of the water supplied by the gas supply pump 95 to lower than the atmospheric pressure independent of the pressure capacity of the pump.

The pressure control valve 92 or the pressure control valve 92*b* of the Device of an embodiment example of this invention has a function to control the pressure of an area of the Device filled with gas so that the difference between the pressure of the area filled with gas and the pressure of the liquid surrounding the Device is kept constant as the liquid pressure may increase because it increases as the depth increases when the Device adheres to and moves along the surface of an object immersed in liquid.

If the liquid pressure is much greater than the pressure of the area filled with gas, the pressure of the liquid presses the area filled with gas against the surface of the object with great force, and the Device will need extremely strong power to move along the surface.

In reference to the method how to output each of the pilot pressure for the pressure control valve 92 or the pressure control valve 92*b*, each pilot pressure is outputted by the pressure relief and regulating valve 943 or the pressure relief and regulating valve 943*b*.

The Device being provided a pressure sensor which can output a voltage or an electric current in proportion to the depth, the pressure relief and regulating valve 943 or the pressure relief and regulating valve 943*b* can output the pilot pressure in proportion to the depth.

The output pressure of the pressure relief and regulating valve 943 or the pressure relief and regulating valve 943*b* is controlled by the voltage or the electric current in proportion to an input voltage or an input electric current.

Installed between the coupler 221 and the coupler 211 is a differential pressure control valve 82.

The differential pressure control valve 82 is a widely-known valve, but will be explained below in reference to FIG. 7. The casing 821 of the differential pressure control valve 82 is roughly divided into two chambers: a valve storage chamber (both areas 831 and 832) and a valve drive chamber 834. In FIG. 7, however, the valve storage chamber and the valve drive chamber are one and the same area with the same pressure because they are connected by a hole. Inside the valve storage chamber, a disc-shaped valve 827 is descended to close a valve opening 831 by the actions of a compressed coil spring 835 and a drive rod 826. When the valve 827 closes the valve opening 831, the valve storage chamber is divided into two chests: an upstream side valve chest 831 and a downstream side valve chest 832. In the figures showing the present embodiment example, the upstream side valve chest 831 and the valve opening 831 are one and the same.

Explained below is the operation of the differential pressure control valve 820 shown in FIG. 7 using formulas.

The aggregate force that acts downwards on the valve 827 toward its closing position Ft1 kgf is: Fa=Pa*Da*Da*3.14/4 Ft1=Fa+Fs Ft1=Pa*Da*Da*3.14/4+Fs The aggregate force that acts upwards on the valve 827 toward its opening position Ft2 kgf is: Fb=Pb*Da*Da*3.14/4 Ft2=Fb Ft2=Pb*Da*Da*3.14/4

The conditions for the valve 827 to open are: Ft1<Ft2 Pa*Da*Da*3.14/4+Fs<Pb*Da*Da*3.14/4 Fs<(Pb−Pa)*Da*Da*3.14/4

Where Pa kgf/cm2 is the absolute pressure of Area I 11 and the downstream side valve chest 832, Pb kgf/cm2 is the absolute pressure of the upstream side valve chest 831, Da cm is the effective diameter of the valve 827, Fa kgf is the force that presses downwards the valve 827 at the downstream side valve chest 832, Fb kgf is the force that presses upwards the valve 827 at the upstream side valve chest 831, and Fs kgf is the force that the coil spring 835 presses the valve 827 downwards.

The above formulas show that the force of the coil spring 835 that presses downwards the valve 827: Fs kgf is expresses as functions of the Pa value of the absolute pressure of Area I 11: Pa kgf/cm2 that is the goal value of pressure setting, the Pb value of the absolute pressure of Area II 12: Pb kgf/cm2 that is the goal value of pressure setting, and the effective diameter of the valve 827: Da cm.

In other words, it is shown that that, once the pressure of Area II is set at a certain designated goal pressure, the pressure of Area I 11 can easily be adjusted to that goal pressure. Assuming, for example, that the value of Pa of the absolute pressure of Area I 11: Pa kgf/cm2 is approximately 0.62, and assuming the value of Pb of the absolute pressure of Area II: Pb kgf/cm2 is approximately 0.65, the differential pressure control valve 82 can easily be preset so that the valve 827 is opened when Pa<0.62 and the valve 827 is closed when Pa>0.65. In other words, when the absolute pressure of Area I 11 attempts to fall below 0.62 kgf/cm2 due to a pressure loss increase as the gap between the outer seal member 31 and the surface of an object 1 decreases, the valve 827 is opened and water moves from Area II 12 to Area I 11, and the absolute pressure of Area I 11 is maintained at 0.62 kgf/cm2.

As shown above, the Device of the embodiment of the invention is explained, but as for the Device of the embodiment of the invention, it is possible to conceive various embodiments, based on the scope of the claims, other than the preferred embodiments.

The technical objective of the first present invention is to provide a device capable of adhering to and moving along the surface of an object immersed in liquid, wherein the pressure of gas in Area I is so maintained at a lower level than the pressure of the liquid surrounding the device that gas inside of Area I may not be issued outside of the device from the gap between the outer sealing member and the surface of the object.

The technical objective of the second present invention is to provide a device capable of adhering to and moving along the surface of an object in the air, wherein the device is so equipped with the area II which is filled with gas that the various kinds of tools which works on the surface of the object may be installed in the area II such as a thermal spraying device, a welding device which adheres molten materials to surfaces, a device which adheres plastic sheets to surfaces, a device which sprays paint or glue onto surfaces, and a device which heat-processes surfaces.

According to being solved the technical objectives described above, effects of the present invention are created as explained below.

Effects of the present invention will be explained below.

In reference to the effects of the first invention, when a cleaning and polishing material is blasted onto the surface of an object immersed in liquid using compressed air, for example, to roughen the surface, upon which time, the used cleaning and polishing material is to be recovered and collected in a container located on land using air suction, the surrounding liquid must be disallowed to enter the blasting area of the cleaning and polishing material. There are various other operations that must also disallow the entry of liquid into the area of the surface of an object being worked on, similar to the case of the blasting operation of a cleaning and polishing material. For example, an operation that uses a thermal spraying device, a device that adheres molten materials to surfaces, such as a welding device, a device that adheres plastic sheets to surfaces, a device that sprays paint or glue onto surfaces, and a device that heat-processes surfaces is affected adversely by the entry of liquid into the area of the surface of an object being worked on.

A device that works on the surface of an object whose performance is adversely affected by the entry of liquid into the area of the surface of the object being worked on, as described above, needs to have an area free from the entry of liquid and filled with gas.

The Device of the present invention has a mechanism that prevents liquid from entering the area of the surface of an object that is being worked on.

Some of these devices exhibit further excellent performance when the surface is in contact with an inert gas in which the concentration of oxygen is at low level.

For example, a thermal spraying device or a welding device has an advantage in that the quality is increased because the oxidation of the melted material is inhibited in order that the material is melted in an inert gas.

In reference to the additional effects of the first invention, when the Device immersed in liquid has an area filled with gas, the pressure of the area filled with gas needs to be controlled so that the difference between the pressure of the area filled with gas and the pressure of the liquid is kept constant as the liquid pressure may increase because it increases as the depth increases. If the liquid pressure is much greater than the pressure of the area filled with gas, the pressure of the liquid presses the area filled with gas against the surface of the object with great force, and the Device will need extremely strong power to move along the surface.

The Device of the present invention is so made as to control the pressure of the area filled with gas so that the difference between the pressure of the area and the pressure of the liquid is kept constant when the pressure of the liquid may increase as the depth increases.

POTENTIAL INDUSTRIAL APPLICATION

As described above, the Device capable of capable of adhering to and moving along the surface of an object immersed in liquid may be conveniently used as a device that can have various devices which perform various operations on the surface of the object immersed in liquid mounted thereon and can move those devices along the surface of the object. For example, the said device can be conveniently used as a device that performs a blasting operation of a cleaning and polishing material or a spraying operation of a molten material on the surface of a portion immersed in sea water of a marine structure. Those devices that act on the surface of an object which are mounted on the Device of the present invention include thermal spraying devices, devices that allow molten materials to adhere to a surface, such as welding devices, devices that allow plastic sheets to adhere to a surface, devices that spray paint or glue onto a surface, devices that heat-process the surface of an object and various other devices. These devices will exhibit better performance because the surface of the object being worked on is in contact with gas, not with liquid.

Figure 1:
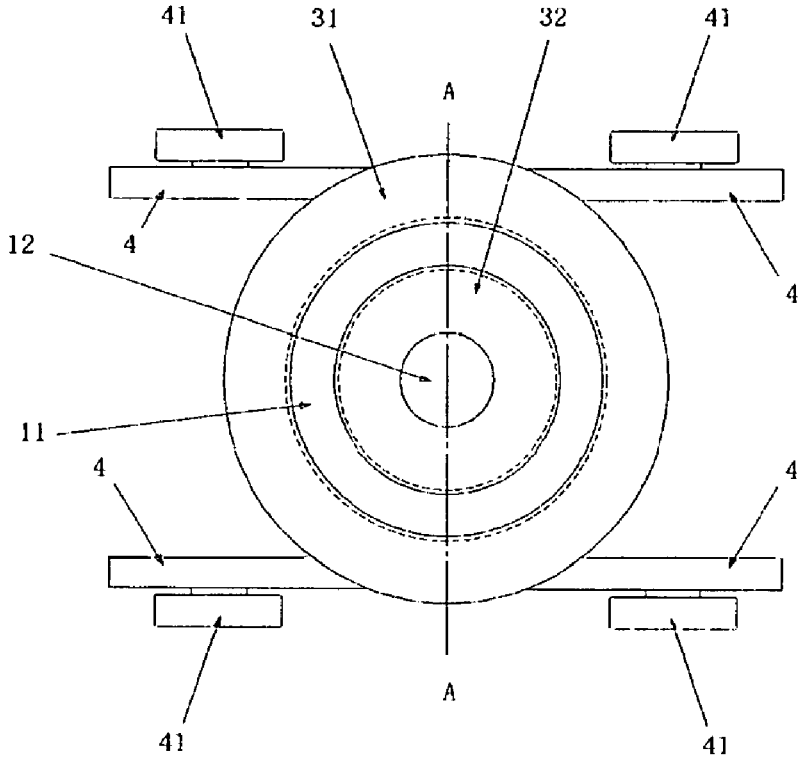
FIG. 1 is a top view of a preferred embodiment of the device configured according to the present invention that is seen from the surface of an object.
Figure 2:
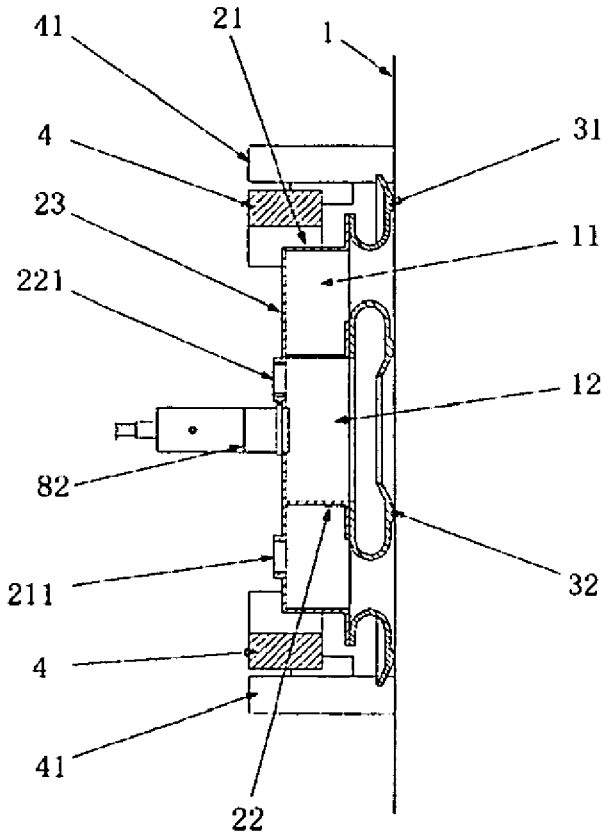
FIG. 2 is a sectional view along the line A - A of the device shown in FIG. 1.
Figure 3:
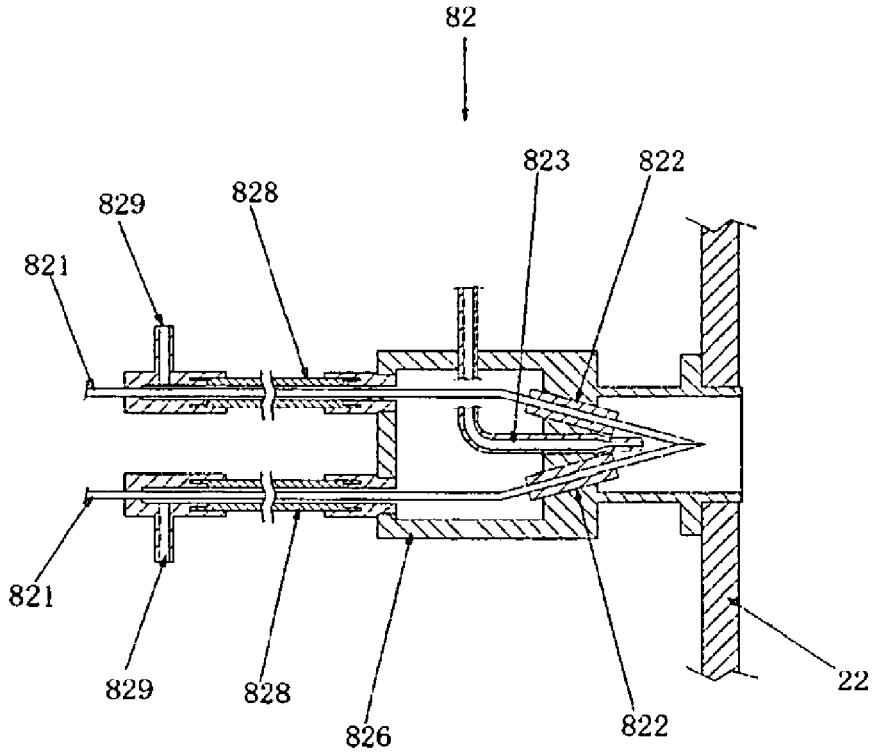
FIG. 3 is a section view of the electric arc thermal spraying device configured according to the present invention.
Figure 4:
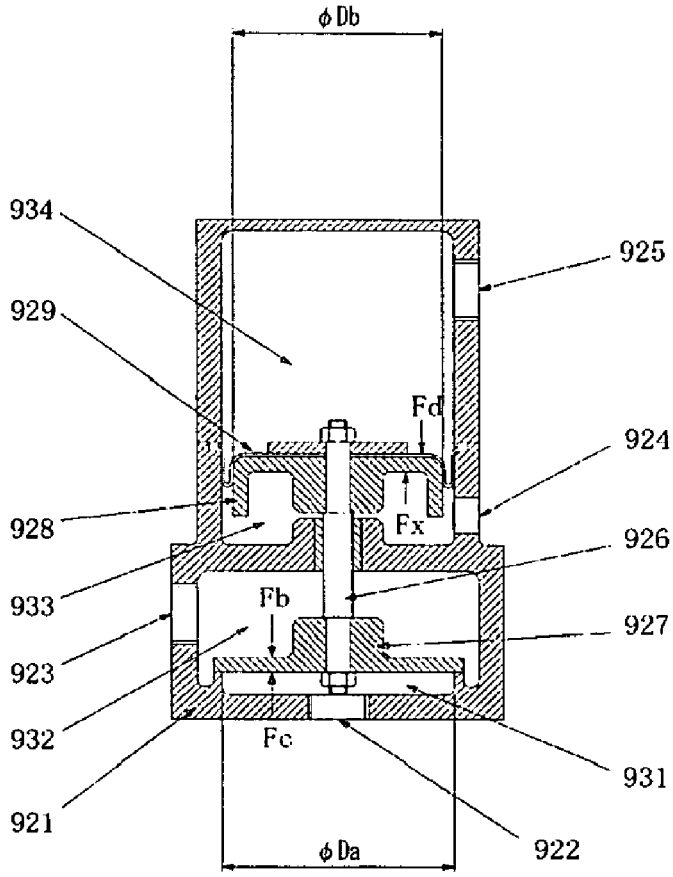
FIG. 4 is a section view of the first example of the pressure control valve configured according to the present invention.
Figure 5:
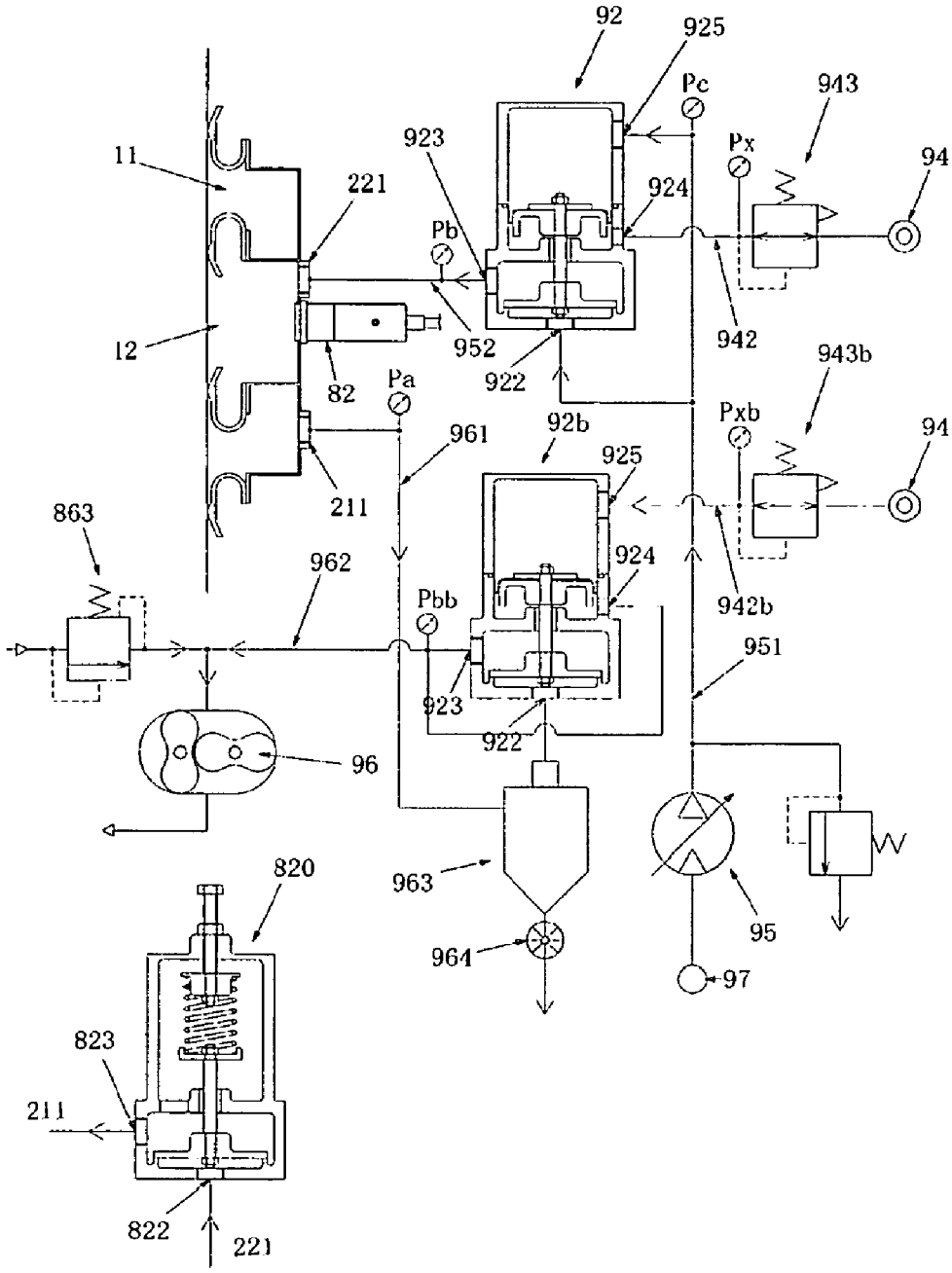
FIG. 5 is a diagram showing the overall system of the device configured according to the present invention.
Figure 6:
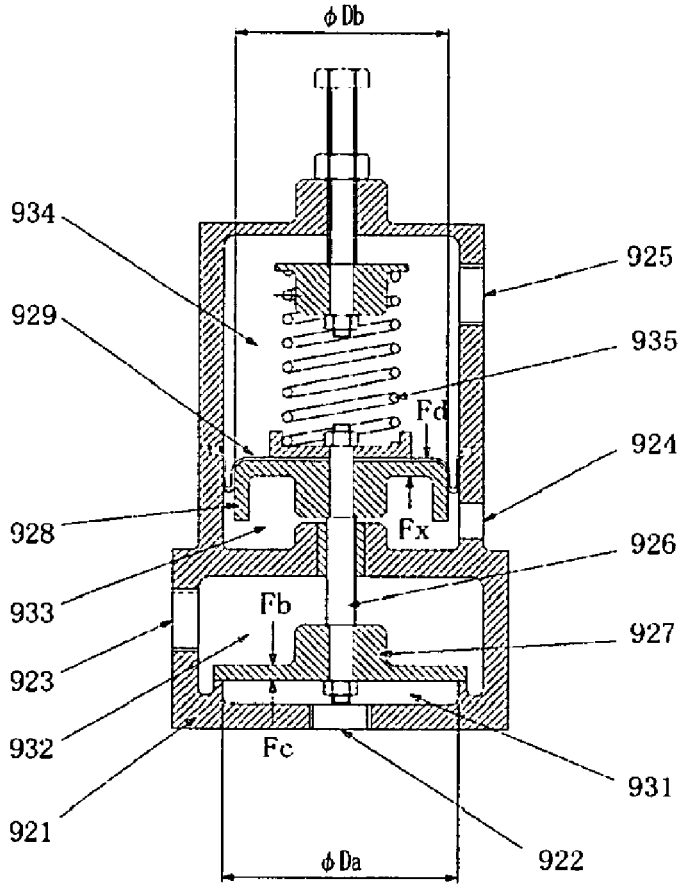
FIG. 6 is a section view of the second example of the pressure control valve configured according to the present invention.
Figure 7:
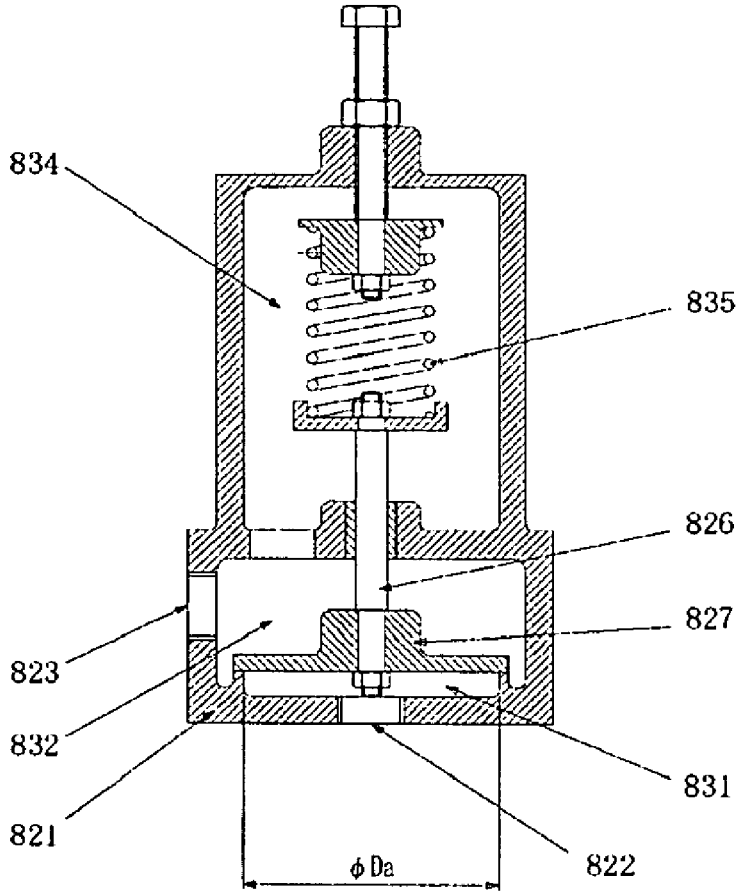
FIG. 7 is a section view of the differential pressure control valve configured according to the present invention that connects Area I 11 to Area II 12.

The invention claimed is:

1. A device capable of adhering to and moving along a surface of an object immersed in liquid, comprising:

a main casing at least comprising an outer casing and an inner casing;

an outer sealing member mounted at an opening of the outer casing, part of which is caused to contact the surface of the object;

an inner sealing member mounted at an opening of the inner casing, part of which is caused to contact the surface of the object; and a first means for moving along the surface of the object while maintaining a certain distance between the main casing and the surface of the object;

wherein at least the outer casing, the outer sealing member and the inner sealing member, together with the surface of the object, define Area I, and at least the inner casing and the inner sealing member, together with the surface of the object, define Area II;

wherein the main casing is configured so that a pressure of fluid in Area I is maintained at a lower level than a pressure of fluid surrounding the Device, and a pressure of fluid in Area II is maintained at a higher level than the pressure of fluid in Area I.

2. A device capable of adhering to and moving along a surface of an object in air, comprising:

a main casing at least comprising an outer casing and an inner casing;

an outer sealing member mounted at an opening of the outer casing, part of which is caused to contact the surface of the object;

an inner sealing member mounted at an opening of the inner casing, part of which is caused to contact the surface of the object; and a first means for moving along the surface of the object while maintaining a specific distance between the main casing and the surface of the object;

wherein at least the outer casing, the outer sealing member and the inner sealing member, together with the surface of the object, define Area I, and at least the inner casing and the inner sealing member, together with the surface of the object, define Area II;

wherein the main casing is configured so that a pressure of fluid in Area I is maintained at a lower level than a pressure of fluid surrounding the Device, and a pressure of fluid in Area II is maintained at a higher level than the pressure of fluid in Area I.

3. The Device capable of adhering to and moving along the surface of an object described in one of claims 1 and 2, wherein: the outer sealing member is so shaped as to be caused to be pressed against the surface of the object by a difference between the pressure of fluid in Area I and the pressure of fluid that surrounds the Device, and the inner sealing member is so shaped as to be caused to be pressed against the surface of the object by a difference between the pressure of fluid in Area I and the pressure of fluid in Area II.

4. The Device capable of adhering to and moving along the surface of an object described in one of claims 1 and 2, wherein: a second means is provided for an inert gas to flow into Area II.

5. The Device capable of adhering to and moving along the surface of an object described in one of claims 1 and 2, further having a pressure adjustment means that adjusts the pressure of Area I said pressure adjustment means comprising an upstream side valve chest connected to Area I, a downstream side valve chest connected to a negative pressure forming means, a valve opening connecting the upstream side valve chest and the downstream side valve chest, a valve that opens and closes the valve opening and a valve-operating means that causes the valve to open and close, so configured that the pressure of Area I is adjusted to a designated pressure by way of the valve being opened or closed due to a difference between the actual pressure of Area I and the designated pressure.

6. The device according to claim 1, wherein said main casing further includes a circular plate portion disposed between the outer casing and the inner casing, said circular plate portion having a shape corresponding to Area I.

* * * * *